US008510899B2

(12) United States Patent
Bouma et al.

(10) Patent No.: US 8,510,899 B2
(45) Date of Patent: Aug. 20, 2013

(54) AUTOMATIC CLEANING AIR IDLER

(75) Inventors: Timothy Bouma, Corvallis, OR (US); Timothy Souza, Lebannon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 253 days.

(21) Appl. No.: 13/058,237

(22) PCT Filed: Oct. 10, 2008

(86) PCT No.: PCT/US2008/079594

§ 371 (c)(1),
(2), (4) Date: Feb. 9, 2011

(87) PCT Pub. No.: WO2010/042123

PCT Pub. Date: Apr. 15, 2010

(65) Prior Publication Data

US 2011/0131751 A1 Jun. 9, 2011

(51) Int. Cl.
*B21B 45/00* (2006.01)

(52) U.S. Cl.
USPC ..... 15/256.51; 15/309.1; 162/281; 101/424; 34/124

(58) Field of Classification Search
USPC ..... 15/256.51, 256.52, 309.1, 1.51; 162/193, 162/199, 272, 281; 101/423, 424, 425; 399/237, 349; 34/114–124
See application file for complete search history.

(56) References Cited

U.S. PATENT DOCUMENTS

| | | | | |
|---|---|---|---|---|
| 3,654,654 | A * | 4/1972 | Abreu et al. | 15/1.51 |
| 3,999,239 | A * | 12/1976 | Misuna | 15/88 |
| 4,911,074 | A | 3/1990 | Simila | |
| 5,027,462 | A * | 7/1991 | Kunzig et al. | 15/1.51 |
| 5,265,537 | A | 11/1993 | Gasparrini et al. | |
| 5,515,619 | A * | 5/1996 | Kahl et al. | 34/114 |
| 2001/0029860 | A1 | 10/2001 | Lundin et al. | |
| 2002/0134882 | A1 * | 9/2002 | Lind | 242/615.12 |
| 2003/0231903 | A1 * | 12/2003 | Kim | 399/237 |

FOREIGN PATENT DOCUMENTS

| | | | |
|---|---|---|---|
| CN | 101041284 | A | 9/2007 |
| JP | 57210382 | A * | 12/1982 |
| JP | 200389966 | A | 3/2003 |

OTHER PUBLICATIONS

JP57210382A (Abstract), 1982.*

* cited by examiner

*Primary Examiner* — Mark Spisich
*Assistant Examiner* — Andrew A Horton

(57) ABSTRACT

A system and method for self cleaning an air idler are provided. An air idler non-contactingly guides printable media using a flow of fluid through a porous surface portion. Rotation of the air idler results in rubbing contact with one or more wipers, during which debris is removed from the porous surface portion. A cleaning solution is used to remove ink and/or paper residue from the porous surface portion. The cleaning solution can wet one or more of the wipers. The cleaning solution can circulate through a reservoir disposed in contact with a portion of the air idler.

12 Claims, 3 Drawing Sheets

AUTOMATIC CLEANING AIR IDLER

BACKGROUND

A web press environment is one in which printing (i.e., imaging) is formed on a flexible media while the media is in motion along a path through the web press apparatus. Typically, the media begins in roll form and is spooled out from an unwinder, printed while in transit through the web press apparatus, and collected back into roll form by a rewinder. Guiding the media through the web press typically involves numerous rollers and idlers.

One known type is an air idler, wherein pressurized gas (e.g., dry air) flows outward from the idler through a porous surface area. The flow of gas keeps the passing media in non-contacting near adjacency to the idler. The overall effect is somewhat like a puck gliding over an air hockey table. Air idlers are used, for example, where the just-printed surface of the flexible media must face toward the air idler while being routed from a printer section to a dryer section of the web press apparatus without compromising print quality.

During typical operations, ink (i.e., imaging media) and/or paper residue build up on the air idlers of a web press apparatus. This residue and/or other debris must be periodically cleaned from the air idlers or printing quality will eventually suffer. Heretofore, it has been necessary to stop web press operations in order to clean air idlers by hand. This "down time" is undesirable from a production standpoint, and includes various personnel access difficulties and other maintenance burdens.

Accordingly, the embodiments described hereinafter were developed in light of these and other drawbacks associated with the manual cleaning of air idlers.

BRIEF DESCRIPTION OF THE DRAWINGS

The present embodiments will now be described, by way of example, with reference to the accompanying drawings, in which.

DETAILED DESCRIPTION

Introduction

Apparatus and methods for automatically cleaning an air idler are provided. One or more air idlers non-contactingly guide printable media in a web press apparatus using fluid flow (e.g., dry air) through porous surface portions of the idlers. Rotation of the air idlers results in rubbing contact with respective wipers, during which debris is removed from the porous surface portions. A cleaning solution can also be used to remove ink and/or paper residue from the porous surfaces. The cleaning solution can be used to wet one or more of the wipers. The cleaning solution can also be circulated through respective reservoirs in contact with the air idlers.

In one embodiment, an apparatus includes an idler having a porous surface portion. The idler is configured to be selectively rotated in at least one direction. The apparatus also includes at least one wiper that is configured to clean debris from the porous surface portion when the idler is rotated against the wiper.

In another embodiment, a method includes rotating an idler in rubbing contact with at least one wiper. The method also includes cleaning debris from a porous surface portion of the idler by way of contact with the at least one wiper.

In yet another embodiment, an apparatus includes an air idler having a porous surface portion. The air idler is configured to non-contactingly guide a printable flexible media by way of a pressurized gas flowing outward through the porous surface portion. The air idler is further configured to be selectively rotated in at least one direction. The apparatus also includes one or more wipers supported in contact with the air idler. Each wiper is configured to remove debris from the porous surface portion when the air idler is rotated in rubbing contact therewith.

First Illustrative Embodiment

Figure 1:
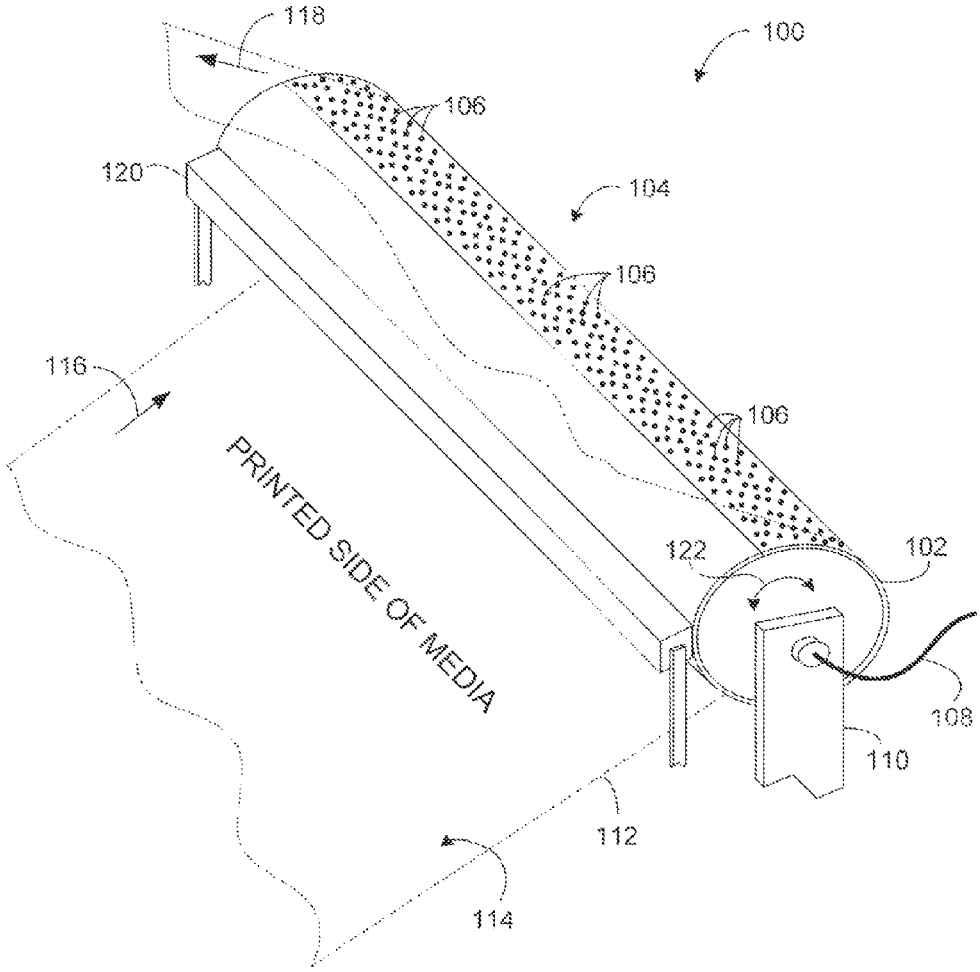
FIG. 1 depicts a perspective view of an air idler system according to one embodiment.

FIG. 1 depicts an air idler assembly 100 according to one embodiment. The assembly 100 includes an air idler 102 including a porous surface portion 104. The porous surface portion 104 is defined by numerous pores 106 extending through the surface into an interior cavity (not shown) of the air idler 102. Pressurized gas such as, for example, dry air, is provided to the interior cavity of the air idler 102 by way of a fluid conduit 108. In turn, the air idler 102 is mechanically supported by one or more supports 110 in relationship to the other features of a web press apparatus (not shown in the interest of simplicity). It is to be understood that such a web press apparatus can include any suitable number of air idlers 102.

Still referring to FIG. 1, a flexible printable media (e.g., paper, etc.) 112 is guided (i.e., routed, or redirected) by the air idler 102 by way of non-contacting adjacency to the porous surface portion 104. The media 112 includes a just-printed surface 114 that faces toward the air idler 102 while traveling past. In this way, the media 112 is guided as needed through a web press apparatus without bringing the, imaged surface 114 into contact with the one or more air idlers 102, thus preserving the printing and/or imaging intact and without contact-related streaks, voids or other damage. It is noted that the media 112 approaches the air idler 102 along a first direction 116 and proceeds away from the air idler 102 along a second direction 118. Thus, the air idler 102 is instrumental in changing the direction of travel of the moving media 112.

The air idler assembly 100 further includes a cleaning element 120 supported in contact with the air idler 102. The cleaning element 120 is also referred to as a wiper. The wiper 120 is configured to remove ink (i.e., imaging media) residue, paper residue and/or other debris (i.e., unwanted materials or contaminants) from the porous surface portion 104 when the air idler 102 is rotated or oscillated as indicated by the bidirectional arrow 122. Thus, the wiper 120 operates by way of rubbing contact with the air idler 102 during times when the air idler 102 is rotated about its longitudinal axis.

The wiper 120 can be formed from a generally soft, non-damaging material such as, for example, felt, cotton, etc. The wiper 120 can be wetted with a cleaning solution selected to dissolve whatever residue or other debris material is sought to be cleaned from the porous surface portion 104 of the air idler 102. While the wiper 120 is depict as having a generally square cross-section, it is to be understood that other wipers having correspondingly varying shapes can also be used.

Second Illustrative Embodiment

Figure 2:
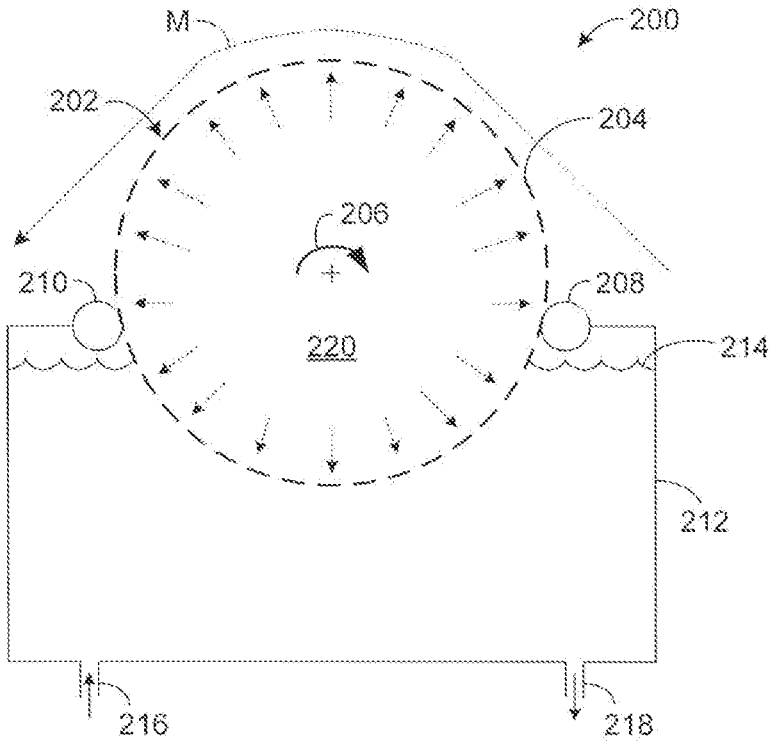
FIG. 2 depicts an end schematic view of an air idler system according to one embodiment.

FIG. 2 depicts an end schematic view depicting an air idler assembly 200 in accordance with one embodiment. The assembly 200 includes an air idler (idler) 202. The air idler 202 includes a porous surface portion 204 that extends around the circumference of the air idler 202. The porous surface portion 204 can be formed from any suitable material such as, for non-limiting example, stainless steel, brass, aluminum, etc. The air idler 202 is supported and mechanically driven (not shown) so as to be selectively rotated about a longitudinal axis in the direction of arrow 206. While the arrow 206 indicates a particular direction of rotation from the perspective of the viewer, it is to be understood that the air idler 202 can be configured for rotation in the opposite direction.

The assembly 200 also includes a pair of wipers 208 and 210. The wipers 208 and 210 can also be referred to as wipers/seals for reasons that are explained below. The wipers/seals 208 and 210 extend along the length of the air idler 202 and are configured to remove debris from the porous surface portion 204 when the air idler 202 is rotated in rubbing contact there against. The wipers/seals 208 and 210 can be formed from any suitable material such as, for non-limiting example, woolen felt, cotton, fiberglass, etc.

The assembly 200 further includes a reservoir 212 that contains a cleaning solution 214. The cleaning solution is selected so as to dissolve and remove residual material adhering to the porous surface portion 204 of the air idler 202. In one embodiment, the cleaning solution 214 is selected so as to remove ink and/or paper residue as can be used in a thermal ink jet (TIJ) printing environment. Other cleaning solutions directed to removing other materials can also be used.

In any case, the reservoir 212 is supported such that at least a part of the air idler 202 is in contact with, or essentially submerged in, the cleaning solution 214. Furthermore, rotation of the air idler 202 will gradually bring the entire porous surface 204 into contact with the cleaning solution 214. The cleaning solution 214 can be supplied to and removed from (i.e., circulated through) the reservoir 212 by way of fluid access ports 216 and 218, respectively.

During typical operations of the assembly 200, pressurized gas such as, for non-limiting example, dry air, is provided to an interior cavity 220 of the air idler 202. The pressurized gas flows outward from the air idler 202 through the porous surface 204, as represented by the dotted arrows. In turn, a flexible media "M" is guided in non-contacting near adjacency about the air idler 202 by virtue of the "cushion" resulting from the pressurized gas flow.

Normally, ink residue, paper residue and/or other debris would accumulate during use on the porous surface portion 204 of the air idler 202. In response to this problem, the air idler 202 of the present teachings is rotated in the direction 206 in rubbing contact with the wiper/seals 208 and 210. The first wiper/seal 208 then serves to remove relatively large debris (e.g., paper particles, etc.) from the porous surface portion 204.

As the air idler 202 is rotated, the porous surface portion 204 is progressively submerged in the cleaning solution 214, which acts to dissolve and remove ink residue, paper residue, and/or other adhering material. The second wiper/seal 210 acts to wipe cleaning solution 214 and any remaining media residue from the porous surface portion 204 of the air idler 202. The wiper/seals 208 and 210 further serve to prevent or substantially limit egress of cleaning solution 214 and/or pressurized gas (e.g., air) from the reservoir 212. Full rotation of the air idler 202 results in a complete cleaning of the entire porous surface portion 204.

Circulation of the cleaning solution 214 through the reservoir 212 allows for filtering (not shown) or other means to ultimately extract the removed ink and/or paper residue, thus scrubbing the cleaning solution 214 for reuse. Additionally, the cleaning solution 214 may require replacement from time to time depending on constituency, usage, and other factors obvious to one having ordinary skill in the art.

Cleaning of the porous surface portion 204 of the air idler 202 can be performed periodically, continuously, or on an as-needed, time to time basis. In any case, the assembly 200 provides an air idler system which may be cleaned in an essentially automatic manner and without interrupting any printing operations being performed on the media M.

Third Illustrative Embodiment

Figure 3:
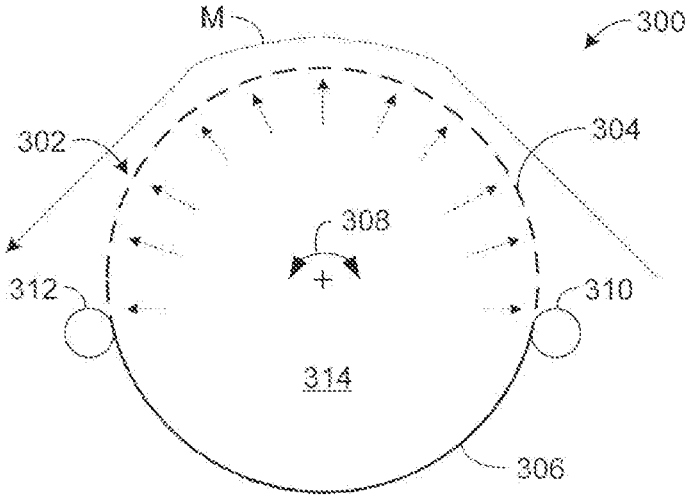
FIG. 3 depicts an end schematic view of an air idler system according to another embodiment.

FIG. 3 depicts an end schematic view depicting an air idler assembly 300 in accordance with another embodiment. The assembly 300 includes an air idler (idler) 302. The air idler 302 includes a porous surface portion 304 that defines a part of the circumference of the air idler 302. The porous surface portion 304 can be formed from any suitable material such as, for non-limiting example, stainless steel, brass, aluminum, etc. The air idler 302 also includes a non-porous surface portion 306 that extends around that part of the air idler 302 circumference not defined by the porous surface portion 304. The air idler 302 is supported and mechanically driven (not shown) so as to be selectively, bidirectionally rotated (or oscillated) in the directions indicated by arrow 308.

The assembly 300 also includes a pair of wipers 310 and 312. The wipers 310 and 312 extend along the length of the air idler 302 and are configured to remove debris from the porous surface portion 304 when the air idler 302 is rotated in rubbing contact there against. The wipers 310 and 312 can be formed from any suitable material such as, for non-limiting example, woolen felt, cotton, fiberglass, etc. Two wipers 310 and 312 are shown in the assembly 300. However, other embodiments respectively having any suitable number of such wipers can also be used.

In any case, the wipers 310 and 312 are configured to be wetted by a cleaning solution (not shown). The cleaning solution is selected so as to dissolve residual material adhering to the porous surface portion 304 of the air idler 302. In one embodiment, the cleaning solution is selected so as to dissolve ink (i.e., imaging media) and/or paper residue as can be used in a TIJ printing environment. Other cleaning solutions directed to removing other materials can also be used. The cleaning solution can be provided to the wipers 310 and 312 continuously, periodically, or from time to time in accordance with the cleaning load. It is noted that the respective contact locations of the wipers 310 and 312 coincide with the interfaces (i.e., seams, or transitions) between the porous surface portion 304 and the non-porous surface portion 306.

During typical operations of the assembly 300, pressurized gas such as, for non-limiting example, dry air, is provided to an interior cavity 314 of the air idler 302. The pressurized gas flows outward from the air idler 302 through the porous surface 304, as represented by the dotted arrows. It is noted that the pressurized gas is prevented from escaping through the non-porous surface portion 306. Additionally, a flexible media "M" is guided in non-contacting near adjacency about the air idler 302 by virtue of the pressurized gas flow through the porous surface portion 304.

The air idler 302 is rotated back and forth, or oscillated, as indicated by the bidirectional arrow 308. During this time, the wetted wipers 310 and 312 serve to remove ink residue, paper residue and/or other debris by way of rubbing contact with the porous surface portion 304. Such oscillatory cleaning operations can be performed while printing operations are performed on the media M, or while such printing operations are halted. In either case, the cleaning operations are essentially automated and do not normally require user intervention.

Illustrative Processes

Figure 4:
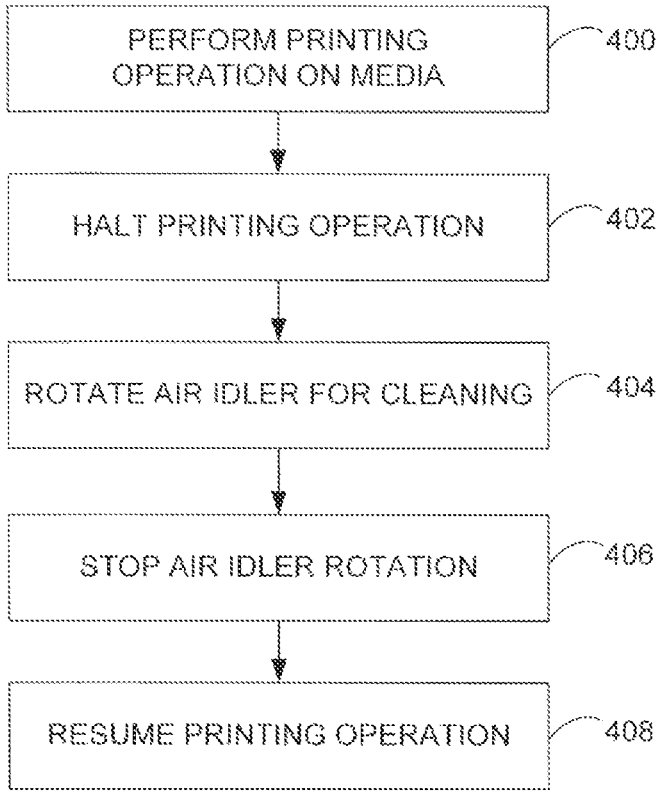
FIG. 4 depicts a flowchart of a method in accordance with one embodiment.

FIG. 4 is a flowchart depicting a method in accordance with one embodiment. The flowchart of FIG. 4 depicts particular method aspects and order of execution. However, it is to be understood that other methods including and/or omitting certain details, and/or proceeding in other orders of execution, can also be used without departing from the scope of the present teachings. Therefore, the method of FIG. 4 is illustrative and non-limiting in nature.

At 400, a printing operation is performed on a flexible media using a web press apparatus. As such, media is moving continuously through the web press simultaneous with the printing. It is presumed that liquid ink is used in a TIJ process for forming images on the moving media.

At 402, the printing operation is halted. The media is brought to a stop during this halted state.

At 404, an air idler is rotated about its central axis. The rotation is presumed to be unidirectional; however bidirectional rotation (cycling back and forth) can also be used. During the rotation, a porous outer surface portion of the air idler is in rubbing contact with one or more wipers. Also, a cleaning solution is used so as to dissolve ink residue, paper residue and/or other unwanted debris materials adhering to the porous surface portion. Application of the cleaning solution can be performed by way of the wetted wipers, a reservoir, or some combination of the foregoing.

At 406, rotation of the air idler is halted. The porous surface portion of the air idler is now clean due to the actions at 404 above.

At 408, the printing operation of the web press is resumed. The media is thus caused to travel through the web press, being guided in non-contacting proximity to the just-cleaned air idler. As a result, imaging (i.e., ink) on the media surface is left undisturbed and undamaged while traversing past the air idler.

Figure 5:
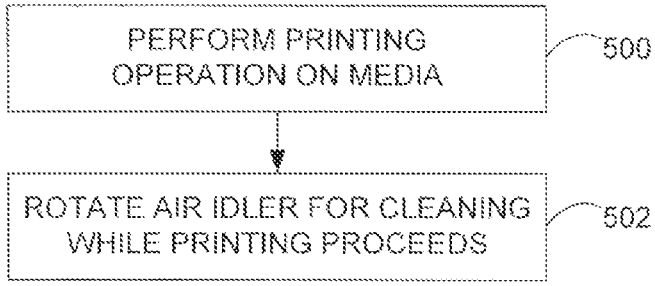
FIG. 5 depicts a flowchart of a method in accordance with another embodiment.

FIG. 5 is a flowchart depicting a method in accordance with one embodiment. The flowchart of FIG. 5 depicts particular method aspects and order of execution. However, it is to be understood that other methods including and/or omitting certain details, and/or proceeding in other orders of execution, can also be used without departing from the scope of the present teachings. Therefore, the method of FIG. 5 is illustrative and non-limiting in nature.

At 500, a printing operation is performed on a flexible media using a web press apparatus. As such, media is moving continuously through the web press simultaneous with the printing. It is presumed that liquid ink is used in a TIJ process for forming images on the moving media.

At 502, an air idler within the web press apparatus is rotated so as to effect cleaning of ink residue, paper residue, and/or other debris from a porous surface portion of the air idler. Rotation of the air idler results in rubbing contact with one or more wipers (i.e., wiper/seals) while a cleaning solution is also used so as to remove ink, paper residue and/or other material. In any case, the printing operation of 500 above continues contemporaneous with the cleaning operation of 502.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An apparatus, comprising:

an idler including a porous surface portion, the idler configured to be selectively rotated in at least one direction;

at least one wiper configured to clean debris from the porous surface portion when the idler is rotated there against; and a reservoir configured to contain a cleaning solution, wherein the at least one wiper is further configured to prevent egress of the cleaning solution from the reservoir.

2. The apparatus according to claim 1, the idler further configured to guide a flexible material in non-contacting adjacency there about by way of a fluid flowing through the porous surface portion.

3. The apparatus according to claim 2, wherein the fluid is pressurized air flowing outward from the idler through the porous surface portion.

4. The apparatus according to claim 1 wherein the reservoir is configured to contain the cleaning solution in contact with at least some of the porous surface portion of the idler.

5. The apparatus according to claim 1, wherein the cleaning solution is selected so as to remove at least ink or paper residue from the porous surface portion of the idler.

6. The apparatus according to claim 4, wherein the idler is configured such that the entire porous surface portion is brought into contact with the cleaning solution by way of rotation of the idler.

7. The apparatus according to claim 1, wherein the cleaning solution is circulated through the reservoir.

8. The apparatus according to claim 1, wherein:

the at least one wiper is wetted with the cleaning solution; and the cleaning solution is selected so as to remove at least ink or paper residue from the porous surface portion of the idler.

9. A method, comprising:

rotating an idler in rubbing contact with at least one wiper;

cleaning debris from a porous surface portion of the idler by way of contact with the at least one wiper;

flowing a fluid outward from the idler through the porous surface portion; and guiding a flexible material in non-contacting adjacency about the idler by way of the flowing fluid, wherein the rotating, the cleaning, the flowing and the guiding are performed simultaneously.

10. The method according to claim 9 further comprising cleaning at least imaging media or paper residue from the porous surface portion of the idler by way of a cleaning solution.

11. An apparatus, comprising:

an air idler having at a porous surface portion and configured to non-contactingly guide a printable flexible media by way of a pressurized gas flowing outward through the porous surface portion, the air idler further configured to be selectively rotated in at least one direction;

one or more wipers supported in contact with the air idler, each wiper configured to remove debris from the porous surface portion when the air idler is rotated in rubbing contact therewith; and a reservoir configured to contain a cleaning solution, wherein the at least one wiper is further configured to prevent egress of the cleaning solution from the reservoir.

12. The apparatus according to claim 11, wherein the cleaning solution is selected so as to remove at least imaging media or paper residue from the porous surface portion of the air idler, the cleaning solution being supported in the reservoir such that at least some of the porous surface portion is brought into contact with the cleaning solution by way of rotation of the air idler.

* * * * *